US005342699A

United States Patent [19]

DeWitte et al.

[11] Patent Number: 5,342,699

[45] Date of Patent: Aug. 30, 1994

[54] STEEL SUBSTRATE FOR REINFORCEMENT OF ELASTOMERS

[75] Inventors: Marc DeWitte, Moen; Walther Van Raemdonck, Zwevegem, both of Belgium

[73] Assignee: N. V. Bekaert S.A., Zwevegem, Belgium

[21] Appl. No.: 781,179

[22] PCT Filed: Jul. 17, 1990

[86] PCT. No.: PCT/EP90/01202

§ 371 Date: Nov. 1, 1991

§ 102(e) Date: Nov. 1, 1991

[87] PCT Pub. No.: WO91/01389

PCT Pub. Date: Feb. 7, 1991

[30] Foreign Application Priority Data

Jul. 21, 1989 [BE] Belgium ..... 89201917.5

[51] Int. Cl.[5] ..... B32B 15/06; D07B 1/06; B60C 9/00

[52] U.S. Cl. ..... 428/625; 428/659; 428/939; 57/902

[58] Field of Search ..... 428/625, 659, 658, 677, 428/939; 152/527, 451, 565; 57/902

[56] References Cited

U.S. PATENT DOCUMENTS

| | | | |
|---|---|---|---|
| 2,296,838 | 9/1942 | Domm | 428/625 |
| 3,858,635 | 1/1975 | Nakamoto et al. | 57/902 |
| 4,202,921 | 5/1980 | Enghag | 428/659 |
| 4,592,935 | 6/1986 | Sato et al. | 428/659 |
| 4,704,337 | 11/1987 | Coppens et al. | 152/565 |

FOREIGN PATENT DOCUMENTS

| | | | |
|---|---|---|---|
| 63-143269 | 6/1988 | Japan | 428/659 |

OTHER PUBLICATIONS

L. Peeters et al., International Polymer Science and Technology, vol. 11, No. 10, 1984, "New Developments in Steel Cords for Tyres", pp. T53–T60.

*Primary Examiner*—John Zimmerman
*Attorney, Agent, or Firm*—Nixon & Vanderhye

[57] ABSTRACT

The invention relates to a substrate for reinforcing elastomeric polymers whereby at least part of the substrate is made of steel, said part being covered by a layer of an alloy consisting of, apart from impurities, between 4.2 and 6.5% weight of aluminum, possibly less than 0.1% of at least one element stimulating the wetting ability of the liquid alloy to the substrate and the balance zinc.

24 Claims, No Drawings

STEEL SUBSTRATE FOR REINFORCEMENT OF ELASTOMERS

BACKGROUND OF THE INVENTION

The present invention relates to a substrate for reinforcement of elastomeric polymers wherein at least part of the substrate is made of steel. Steel wires and cords comprising steel wires twisted together (possibly together with other synthetic filaments such as aramid fibers) are often used for reinforcing rubber products such as tires, belts and hoses. In view of securing a proper and durable adhesion to the rubber, the wire surfaces are generally coated with an alloy layer such as brass or zinc.

Besides a proper adhesion capacity, the coating layer should preferably also protect the wires against corrosion attack. Indeed, corrosion of the reinforcing steel structure should always be avoided as the reinforcing effect decreases as a consequence of corrosion. Besides exposure of the steel elements to atmospheric corrosion before their embedment into rubber, corrosion attack is also possible after such embedment, especially when incisions in the rubber, which reach the wire surfaces, are produced.

Numerous efforts have been made up to now to design specific coating layers for steel wires which offer a good adhesion capacity (also after ageing of the reinforced composite) in combination with a proper corrosion resistance. Unfortunately, the application of those coating layers requires quite complicated processes which generally raise the production cost of the coated reinforcing material. Further, the coating process often becomes quite critical when steel wires are involved with elevated tensile strength e.g. over 3000 N/mm$^2$, as those wires often require specific manufacturing processes.

SUMMARY OF THE INVENTION

It is now a primary object of the invention to provide a relatively simple coating composition and process for a reinforcing steel substrate which offers adequate adhesion strength (and adhesion retention after ageing) to the surrounding elastomeric matrix combined with an improved resistance against static and dynamic corrosion attack. In particular it is an object of the invention to provide a reinforcing substrate for elastomeric polymers as defined in claim 1.

It is a second object of the invention to provide such coatings on steel wire substrates with an elevated tensile strength.

According to another object of the invention, a bundle, e.g. a twisted cord or cable is provided comprising a number of said steel wires, possibly combined with filaments of other material.

Another object of the invention deals with the combination of steel wires of different kinds in said bundle or cord, e.g. wires with different diameter and/or strength.

Yet another object of the invention relates to the combination of the simple coating composition and/or process with the deposition of a specific sublayer and/or top layer of another material in view of meeting specific requirements for adhesion and/or corrosion resistance.

A further object of the invention resides in methods and means for manufacturing and using said steel substrates ,and said combinations of substrates.

An additional object of the invention concerns the elastomeric products reinforced with said substrates such as conveyor belts, transmission belts, (high pressure) hoses, tires etc.

DETAILED DESCRIPTION OF THE PREFERRED EMBODIMENTS

According to the invention, the relatively simple coating layer composition for the reinforcing substrate comprises an alloy which, apart from impurities, consists of between 4.5 and 6.5wt. % of aluminium, possibly less than 0.1% of at least one element stimulating the wetting ability of the liquid alloy to the substrate and the balance zinc. At least a part of the substrate is made of steel, and the above coating layer composition is applied to at least some portions of said part.

It is known from the Japanese patent application 59-173257 to coat a wire with a Zn alloy including 2.5 to 7% Al.

The weight of said layer according to the invention is between 10 and 60 g per m$^2$ of the covered surface of the substrate. Steel wire is a suitable reinforcing substrate. The steel thereby has a carbon content of at least 0.4 wt. % and preferably between 0.7 and 1 wt. %. Further, the steel wire has a tensile strength Rm of at least 2100 N/mm$^2$. However wires with a tensile strength of at least 3100 N/mm$^2$ are also contemplated. In particular wires with $Rm \geqq 2250-1130 \log d$ are envisaged wherein d is the diameter of the wire. The wire may have a round, square or rectangular cross section.

The reinforcing substrate according to the invention can consist of a number of single wires, however it can also comprise a number of filaments bundled together wherein at least one of the filaments is a steel wire with a diameter between 0.08 mm and 0.50 mm. The filaments are preferably bundled together by twisting. Steel wires can then be disposed either in the center of the bundle, in the circumference and/or in an intermediate layer between core and outer layer of the bundle. If desirable, only part of the filaments in either core, circumferential or intermediate layer may be of steel. Often however, all filaments in the twisted bundle will be steel wires.

Further, not all wires in the twisted substrate should have the same diameter or the same tensile strength. A number of wires can have a diameter and/or tensile strength which is different from the diameter or strength of any other wire or filament in the twisted bundle. In particular, a number of wires can have a tensile strength $Rm > 2250-1130 \log d$.

In cases where adhesion and adhesion retention is required to specific rubber compounds, it may be desirable to further cover the steel wire, already provided with the Zn/Al-alloy layer according to the invention, with an additional layer promoting said adhesion to the specific elastomeric polymers. The additional layer may be a metal layer comprising Cu, Zn, Ni and/or Co. In particular said metal layer may comprise brass.

In other instances it may be contemplated to deposit an intermediate or subcoating on the wire substrate before applying the Zn/Al-alloy coating according to the invention. Such a subcoating may comprise Zn and/or Ni.

The invention covers also elastomeric products, reinforced with substrates having the specific Zn/Al-alloy-coating layer at their surface. Hose reinforcement steel wires, hose wire cords, respectively conveyor belt cord with said Zn/Al-alloy coating as well as the so reinforced hoses, particularly high pressure hoses, resp. conveyor and driving or transmission belts are contemplated.

EXAMPLE 1

A steel cord according to the invention (specimen 2 in the table below) and for the reinforcement of a rubber conveyor belt was prepared with the following characteristics: the cord comprised 7 strands twisted together. Each strand consisted of 7 steel wires twisted together. Each wire had a diameter of 0.42 mm, a carbon content of 0.86 wt. % and a Zn—Al-alloy layer with a weight of 42 g per $m^2$ of wire surface. The Zn—Al-alloy comprised about 5 wt. % of Al and about 0.02% La and about 0.02% of Ce as a wetting agent to steel. Besides other impurities the balance of Zn amounted to about 95 wt. %.

The same cord (7×7×0.42—specimen 1—) was prepared; however each wire had a coating of zinc (hot dip) of about 50 g per $m^2$ of wire surface. As explained above, the eutetic Zn—Al-coating has an excellent corrosion resistance which is generally at least three times the corrosion resistance of conventionally galvanised (hot dip Zn-coated) wire when submitted to a salt spray test. This is the reason why corrosion tests were not repeated here.

Applicant however had very much doubts as to the adhesion capacity and adhesion retention after aging of the new Zn—Al-coatings, when compared to Zn-coatings. Therefor the Zn—Al-coated cords described above were embedded and vulcanised in two rubber compounds for conveyor belts. The pull-out force (N/mm) was determined as per AISI/ASTM test. No. 2630 as well as the appearance rating (APR) which is a visual estimation of the degree of rubber coverage after peeling the rubber from the cord layer.

The table 1 below represents the values obtained for each of two compounds A and B, for the Zn-coated cord (specimen 1) and for the Zn—Al-coated cord (specimen 2).

TABLE 1

| | initial adhesion | | aged adhesion 180° C. - 90' | | aged adhesion 150° C. - 240' | |
|---|---|---|---|---|---|---|
| | N/mm | APR | N/mm | APR | N/mm | APR |
| specimen 1 (state of the art) | | | | | | |
| Comp. A | 134 | 7.0 | 104.7 | 9 | 108.3 | 8.3 |
| Comp. B | 131.7 | 7.0 | — | — | 137.0 | 8.7 |
| specimen 2 (invention) | | | | | | |
| Comp. A | 135.0 | 8.0 | 101.7 | 9.0 | 121.3 | 9.0 |
| Comp. B | 119.3 | 8.0 | — | — | 148.0 | 8.3 |

The results obtained indicate that values for initial adhesion (freshly vulcanised composite rubber/cord) are quite comparable for both specimens. This means that the adhesion capacity for Zn—Al-coated cords according to the invention is generally not worse than for conventionally Zn-coated cords. Surprisingly however, the adhesion retention after aging is also excellent for the cords according to the invention and overall even slightly better than for conventionally Zn-coated steel cords. From the above data can thus be concluded that the Zn/Al-coated substrates according to the invention offer at the same time a better corrosion resistance and an adhesion strength to rubber which is in general at least equal to that of conventionally Zn-coated substrates, even after aging. The better corrosion resistance does not only relate to circumstances of static corrosion but also to those of dynamic corrosion which then results in a better corrosion fatigue resistance.

As a proof thereof wet and dry fatigue tests were carried out as set out in example 2 below.

EXAMPLE 2

Steel wire filaments with substantial residual compressive stresses at their surface were coated with the Zn/Al-alloy coating described in example 1. They had a diameter of 0.19 mm resp. 0.21 mm and a tensile strength of between 3600 and 3850 $N/mm^2$ resp. between 3400 and 3600 $N/mm^2$. Three different coating amounts were present on the filaments. The heaviest coating had a weight of about 35 $g/m^2$ of filament surface whereas the coating with the lowest weight was about 11 $g/m^2$. An intermediate coating amount of about 25 $g/m^2$ was tested also.

Conventional fatigue tests were carried out (540.000 cycles) in dry (35% relative humidity) and wet (demineralized water) conditions as described e.g. at the bottom of page 4 of the published European patent application No. 220.766. The results are summarized in the table 2 below:

TABLE 2

| diameter (mm) | coating weight $g/m^2$ | dry fatigue limit $N/mm^2$ | corrosion fatigue limit (wet) $N/mm^2$ |
|---|---|---|---|
| 0.19 | 33 | 1300 | 1200 |
| | 22 | 1400 | 1100 |
| | 13 | 1500 | 925 |
| 0.21 | 37 | 1000 | 975 |
| | 36 | 1300 | 1025 |
| | 11 | 1350 | 1000 |

Professionals in the field will certainly recognise that the values in table 2 are very high.

EXAMPLE 3

A tire cord was prepared of the construction 3×0.21+9×0.19 with a cable pitch of 12.5 mm. The filaments (used in example 1) with a diameter of 0.19 mm and with the Zn/Al-alloy coating weight of 13 g/m2 were unwound from the cord and submitted to the same corrosion fatigue test (wet conditions) as described in example 2. The corrosion fatigue limit value was about 825 N/mm2 which is still considered satisfactory. In fact, due to the twisting operation, corrosion fatigue limits decreased from 925 N/mm2 (example 2) only by about 10 %. The filaments with a diameter of 0.21 mm had a Zn/Al-alloy coating weight of 11 g/m2.

EXAMPLE 4

The cords (1) according to the invention and described in example 3 were embedded in a rubber compound comprising as quantitatively most important ingredients per 100 parts of rubber: 45 parts of C. B. Regal 300; 12.5 parts of Ultrasil VN 3; 8 parts of ZnO; 6 parts of Dutrex 729; 6 parts of sulfur; 5 parts of Cofill 11; 4 parts of Cyrez 963; 2 parts of Santoflex 13 and 1.5 parts of Manobond C 16. The composite was vulcanised for about 25 min. at 150° C.

Adhesion (expressed in N) was determined according to the conventional pull-out test and the appearance rating (APR in %) was noted. The same tests were carried out for comparison on similar cords (2), (3), (4)

(same construction and similar tensile strengths). Cords (2) had on top of the Zn/Al-alloy coating a very thin Co-coating (1000 nm) applied by physical vapor deposition. Cords (3) were conventional brass coated cords (about 63% Cu and 37% Zn) and cords (4) were the same brass coated cords with again a thin Co-layer (of about 1000 nm in thickness) applied by physical vapor deposition. Table 3 summarises the results. Adhesion is somewhat lower for the cords (1) and (2) compared to the brass coated cords (3) and (4) but much better than normally would have been expected by persons skilled in the art. The influence of Co is not very significant for the rubber compound used in these experiments.

TABLE 3

| cord type | adhesion (N) | APR (%) |
|---|---|---|
| (1) | 500 | 89 |
| (2) | 514 | 90 |
| (3) | 578 | 91 |
| (4) | 568 | 93 |

We claim:

1. A reinforcing substrate with improved adhesion retention to elastomeric polymers comprising a plurality of filaments wherein at least one of said filaments is a steel wire covered at least in part by a layer of an alloy consisting of, apart from impurities, between 4.2 and 6.5 wt. % of aluminum, a wetting element which is present in an amount less than 0. 1% sufficient to stimulate the wetting ability of the alloy when liquid to the substrate, and the balance zinc.

2. A substrate element according to claim 1, wherein the weight of said layer is between 10 and 60 g per $m^2$ of the covered surface of the substrate.

3. A substrate according to claim 1 wherein said steel wire has a carbon content of at least 0.4 wt. %.

4. A substrate according to claim 3 wherein said steel wire has a carbon content between 0.7 and 1 wt. % of carbon.

5. A substrate according to claim 3 wherein the steel wire has a tensile strength Rm of at least 2100 $N/mm^2$.

6. A substrate according to claim 5 wherein the steel wire has a tensile strength of at least 3100 $N/mm^2$.

7. A substrate according to claim 5 wherein the tensile strength Rm is larger than 2250−1130 log d wherein d is the diameter of the wire.

8. A substrate according to claim 1 wherein the steel wire has a rectangular cross-section.

9. A substrate according to claim 1 comprising a number of filaments bundled together, wherein at least one of the filaments is a steel wire with a diameter between 0.08 mm and 0.50 mm.

10. A substrate according to claim 9 wherein the filaments are bundled together by twisting.

11. A substrate according to claim 10 wherein at least a part of the filaments in the twisted bundle are centrally disposed filaments which are steel wires.

12. A substrate according to claim 10, wherein at least a part of the filaments in the twisted bundle are circumferentially disposed filaments which are steel wires.

13. A substrate according to claim 10 wherein the twisted bundle includes centrally and circumferentially disposed filaments, and wherein at least a part of those filaments disposed between the centrally and circumferentially disposed filaments are steel wires.

14. A substrate according to claim 10 wherein all the filaments are steel wires.

15. A substrate according to claim 10 or 14 wherein a number of the wires have a diameter which is different from the diameter of any other wire or filament in the twisted bundle.

16. A substrate according to claim 10 or 14 wherein a number of the wires have a tensile strength which is different from the tensile of any other wire or filament in the twisted bundle.

17. A substrate according to claim 16, wherein the wire has a diameter d, wherein said number of wires have a tensile strength $Rm > 2250 - 1130 \log d$.

18. A substrate according to claim 1 wherein said alloy layer is covered at least in part with another layer promoting the adhesion to elastomeric polymers.

19. A substrate according to claim 18 wherein said other layer comprises Cu, Zn, Ni and/or Co.

20. A substrate according to claim 19 wherein said other layer comprises brass.

21. A substrate according to claim 1 or 18 wherein said alloy layer is deposited on an intermediate layer comprising Zn and/or Ni.

22. The use of a steel substrate for the reinforcement of products comprising elastomeric polymers, wherein said steel substrate is covered at least in part by a layer of an alloy consisting of, apart from impurities, between 4.2 and 6.5 wt. % of aluminum, a wetting element which is present in an amount less than 0.1% sufficient to stimulate the wetting ability of the alloy when liquid to the substrate, and the balance zinc.

23. An elastomeric polymer product reinforced with a substrate according to claims 1 or 22.

24. An elastomeric polymer product according to claim 23 in the form of a conveyor belt.

* * * * *